United States Patent [19]

Gould, Jr. et al.

[11] Patent Number: 4,667,545

[45] Date of Patent: May 26, 1987

[54] SCREW GUN AUTOMATIC FEED

[76] Inventors: Frederick H. Gould, Jr.; George Spector, both of 233 Broadway, Rm 3615, New York, N.Y. 10007

[21] Appl. No.: 740,633

[22] Filed: Jun. 3, 1985

[51] Int. Cl.[4] ..... B25B 23/06

[52] U.S. Cl. ..... 81/57.37; 81/433; 81/434

[58] Field of Search ..... 81/57.37, 431, 433, 81/434; 227/114, 136

[56] References Cited

U.S. PATENT DOCUMENTS

| | | | |
|---|---|---|---|
| 2,670,770 | 3/1954 | Potterton | 81/57.37 |
| 2,777,484 | 1/1957 | Groneman | 81/57.37 |
| 3,554,246 | 1/1971 | Halstead | 81/434 |
| 3,960,191 | 6/1976 | Murray | 81/57.37 |
| 4,062,389 | 12/1977 | Lejdegard | 81/434 |
| 4,294,142 | 10/1981 | Sugahara et al. | 81/57.37 |
| 4,404,877 | 9/1983 | Mizumo et al. | 81/57.37 |
| 4,416,172 | 11/1983 | Medinger | 81/57.37 |
| 4,428,261 | 1/1984 | Takatsu et al. | 81/434 |
| 4,623,646 | 11/1971 | Cast | 227/114 X |

*Primary Examiner*—Frederick R. Schmidt
*Assistant Examiner*—Debra S. Meislin

[57] ABSTRACT

An automatic feed screw driver for continuously driving a plurality of screws and adaptable for mounting on a conventional drill and which includes a stationary tube mounted on the drill housing, a stationary sleeve mounted on the barrel of the drill, a spring pressed slide sleeve biased outwardly within the stationary sleeve, a gravity feed tube in communication with the slide sleeve and is slidably mounted on the stationary tube. A spring loaded knife is disposed in the slide sleeve for separating the screws from a tape attached thereto. An element is provided for varying the spring pressure on the slide sleeve.

3 Claims, 3 Drawing Figures

FIG. 1
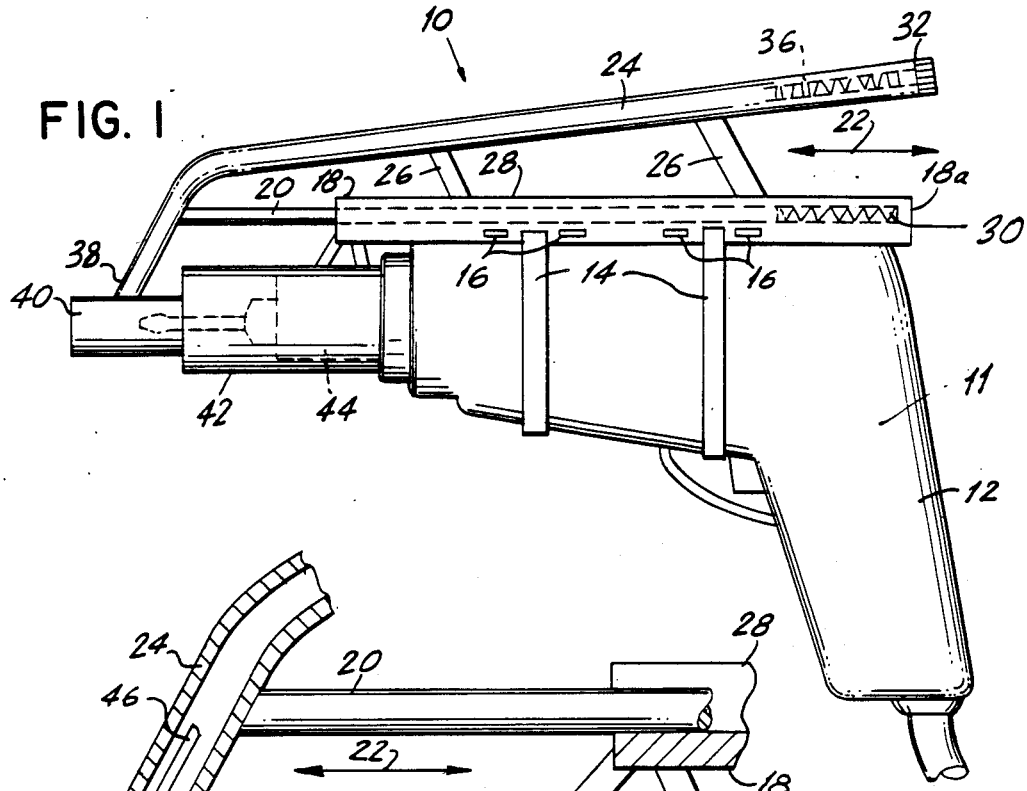
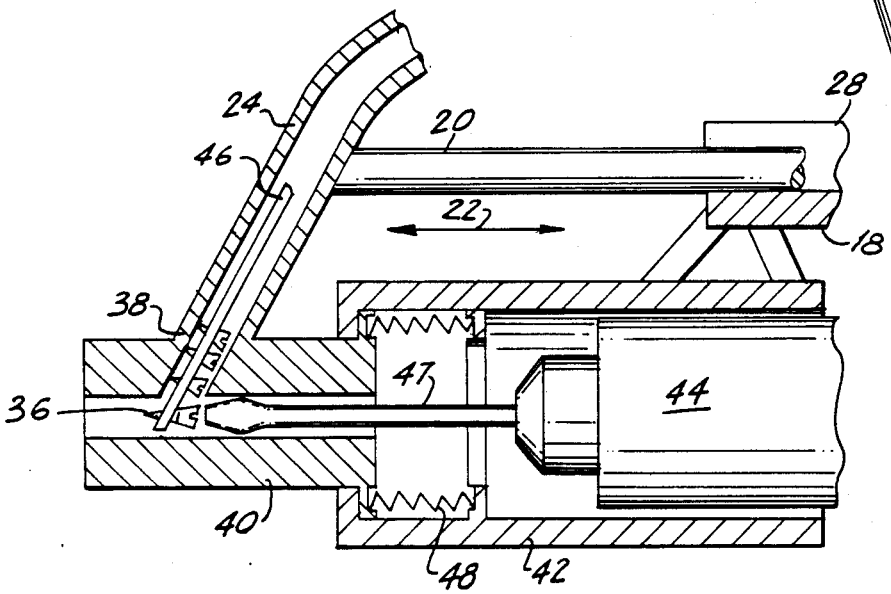
FIG. 2
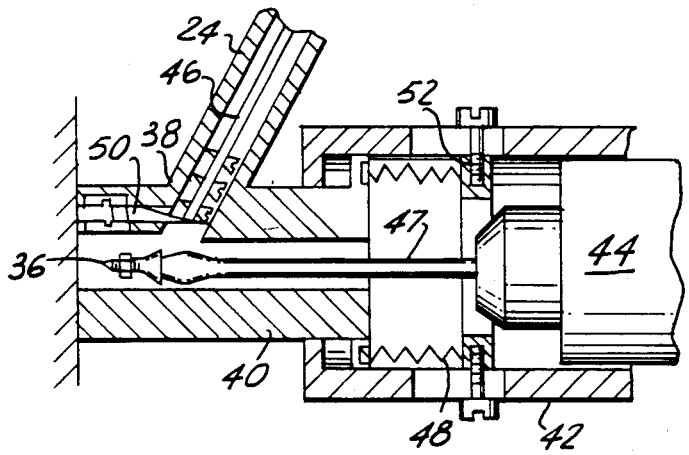
FIG. 3

SCREW GUN AUTOMATIC FEED

BACKGROUND OF THE INVENTION

The present invention relates to an automatic screw feed tool. More particularly, it relates to an automatic screw feed tool using a driving unit.

Automatic screw feed tools of the above-mentioned general type are known in the art. For example, U.S. Pat. No. 2,670,770 to Potterton relates to an automatic screw driver which requires the insertion of individual screws. Other examples, U.S. Pat. No. 2,777,484 to Groneman and U.S. Pat. No. 3,960,191 to Murray also relate to automatic screw drivers which require the insertion of individual screws.

Thus, the prior art teaches automatic screw drivers which require the constant insertion of individual screws.

SUMMARY OF THE INVENTION

Accordingly, it is the primary object of the present invention to provide an automatic screw feed tool that avoids the disadvantages of the prior art.

Another object of the present invention is to provide an automatic screw feed tool utilizing a "belt feed" arrangement of the screws through a hollow feed tube.

Yet another object of the present invention is to provide an automatic screw feed tool which is adaptable to a conventional drill.

Still another object of the present invention is to provide an automatic screw feed tool which is adjustably mounted so as to fit any conventional drill.

BRIEF DESCRIPTION OF THE DRAWINGS

FIG. 1 is a side elevation view of the invention and associated driving tool at rest position;

FIG. 2 is an enlarged cross sectional view of the front portion of the invention corresponding to the position in FIG. 1; and FIG. 3 is an enlarged cross sectional view of the front portion of a modifaction showing an adjustment spring loaded ring and a knife for cutting the tape between the screws with the driving tool starting its driving position.

DETAILED DESCRIPTION OF THE PREFERRED EMBODIMENTS

Referring now to FIGS. 1, the automatic screw feed tool of the present invention is shown generally at 10 mounted to a conventional drill 12. The automatic screw feed tool 10 is mounted to the drill 12 by straps 14 that pass through slots 16 in the stationary tube 18. A slide shaft 20 is movable within the stationary tube 18 in the direction of arrows 22. A feed tube 24 is attached to the slide shaft 20 and moves therewith. Supports 26 riding in a slot 28 further support the feed tube 24.

The stationary tube 18 is closed at a one end 18*a* and biases the slide shaft 20 with a spring 30. The feed tube 24 is closed at a one end 32 by a threaded cap 34 which is removable to load screws 36. The other end 38 of the feed tube 24 is connected to a slide sleeve 40 which is movable in a stationary sleeve 42 which mounts over chuck 44 of the drill 12.

The feeding arrangement is shown in greater detail in FIG. 2. The screws 36 are attached to a tape 46 and ride in the interior of the feed tube 24. A spring 48 biases the slide sleeve 40 in the extended position.

The screws 36 are fed via the tape 46 which is inside the feed tube 24. The tape 46 with the screws 36 mounted therein is inserted into the feed tube 24 by removing the threaded cap 34. The feed tube 24 is guided for longitudinal movement by the stationary tube 18 mounted on the drill 12. The stationary tube 18 may be adjusted longitudinally relative to the drill 12 by means of the slots 16 holding the straps 14.

In operation, the tool 10 is pressed against a working surface which forces the slide sleeve 40 to move inward of the stationary sleeve 42 against the biasing action of the spring 48 whereby the driver 47 is forced to engage the lead screw 36 and drive it forward against the work surface. The driving forward action severs the lead screw 36 from the tape 46 and the screw 36 is then driven into the work surface. Relieving the pressure of the tool 10 from the work surface causes retraction of the driver 47 and permits the next screw 36 to descend into the barrel of the slide sleeve 40.

An alternate embodiment is shown in FIG. 3, where a spring loaded knife 50 is forced inward to cut the tape 46 as the driver 47 engages the lead screw 36 when the tool 10 is pressed against the work surface. Additionally, an adjustment ring 52 can be moved longitudinally in a slot 54 to change the spring pressure of the spring 48, against the slide sleeve 40.

We claim:

1. An automatic feed screw driver and gravity fed screws provided in said driver adapted for mounting on a conventional drill having a screw driver, comprising:

(a) means for removeably mounting the automatic feed screw driver on a drill having a barrel projecting from a housing;

(b) means for guiding the screw driver to engage a screw, one at a time;

(c) means for guiding and feeding the said screws one at a time for engagement with said screw driver, wherein said mounting means include a stationary tube mounted on said drill housing and wherein said means for engaging said screws with said screw driver include a stationary sleeve mounted on said barrel and a spring pressed slide sleeve biased outwardly in said stationary sleeve and wherein said means for guiding and feeding the plurality of screws include an inclined gravity feed tube communicating with a forward end of said slide sleeve and terminating at an upper rearward end with a threaded cap, said threaded cap being removeably mounted so that said plurality of screws may be introduced therein; said plurality of screws being attached to each other by a tape wherein said stationary sleeve is affixed to said stationary tube and wherein said gravity feed tube is slidably mounted on said stationary tube;

(d) means for separating a screw from the plurality of screws which includes a spring loaded knife disposed in said slide sleeve including means to be activated when said slide sleeve is forced inward within said stationary sleeve by manual pressure of the operator against said housing.

2. A driver as in claim 1, wherein said stationary tube is mounted on the top of said housing and includes a guide slot to receive slidingly therein supports dependng from said gravity feed tube.

3. An automatic feed screw driver and gravity feed screws provided in said driver adapted for mounting on a conventional drill having a screw driver, comprising:

(a) means for removeably mounting the automatic feed screw driver on a drill having a barrel projecting from a housing;

(b) means for guiding the screw driver to engage a screw, one at a time;

(c) means for guiding and feeding the said screws one at a time for engagement with said screw driver, wherein said mounting means include a stationary tube mounted on said drill housing and wherein said means for engaging said screws with said screw driver include a stationary sleeve mounted on said barrel and a spring pressed slide sleeve biased outwardly in said stationary sleeve and wherein said means for guiding and feeding the plurality of screws include an inclined gravity feed tube communicating with a forward end of said slide sleeve and terminating at an upper rearward end with a threaded cap, said threaded cap being removably mounted so that said plurality of screws may be introduced therein; said plurality of screws being attached to each other by a tape wherein said stationary sleeve is affixed to said stationary tube and wherein said gravity feed tube is slidably mounted on said stationary tube, wherein said gravity feed tube has a forward portion of greater inclination which intersects a bore in said slide sleeve, including means on said slide sleeve for varying the spring pressure on said slide sleeve and wherein said stationary tube has a spring mounted therein biasing said feed tube forwardly.

* * * * *